US007476823B2

(12) United States Patent
Rostron

(10) Patent No.: US 7,476,823 B2
(45) Date of Patent: Jan. 13, 2009

(54) CURRENT PAUSE DEVICE FOR AN ELECTRIC POWER CIRCUIT INTERRUPTER

(75) Inventor: Joseph R. Rostron, McDonough, GA (US)

(73) Assignee: SSI Power LLC, Hampton, GA (US)

( * ) Notice: Subject to any disclaimer, the term of this patent is extended or adjusted under 35 U.S.C. 154(b) by 874 days.

(21) Appl. No.: 11/061,413

(22) Filed: Feb. 18, 2005

(65) Prior Publication Data

US 2005/0212453 A1 Sep. 29, 2005

Related U.S. Application Data

(60) Provisional application No. 60/548,698, filed on Feb. 27, 2004.

(51) Int. Cl.
*H01H 33/70* (2006.01)

(52) U.S. Cl. ..... 218/80; 218/94; 218/100; 218/40; 361/131; 361/117

(58) Field of Classification Search ..... 218/12, 218/67, 80, 100, 84, 154, 40, 85, 94; 361/131, 361/115, 117, 134, 137, 138; 315/36; 324/536; 200/400

See application file for complete search history.

(56) References Cited

U.S. PATENT DOCUMENTS 2,601,138 A * 6/1952 Hart ..... 218/12
3,176,104 A * 3/1965 Spinnler ..... 218/43
4,356,527 A * 10/1982 Asinovsky et al. ..... 361/134
6,316,742 B1 * 11/2001 Rostron et al. ..... 218/84
6,583,978 B2 * 6/2003 Rostron et al. ..... 361/117
6,972,572 B2 * 12/2005 Mernyk et al. ..... 324/509

* cited by examiner

*Primary Examiner*—Haissa Philogene
(74) *Attorney, Agent, or Firm*—Michael J. Mehrman; Mehrman Law Office, P.C.

(57) ABSTRACT

A current pause device configured to enhance the operation of transmission and distribution line circuit interrupters by delaying the voltage build across the circuit interrupter arc gap for a time period sufficient to allow the dielectric characteristic of the medium within the arc to recover. This allows the circuit interrupter to break the circuit at a lower arc gap voltage than would occur without the current pause device. The current pause device includes a conductive arcing horn and an insulator interposed in the arcing horn to create a conductive gap in the arcing horn and a voltage protection arrangement to limit the voltage across the current pause device and thereby prevent a voltage breakdown across the current pause device. Specifically, the voltage protection arrangement includes a diode connected to the arcing horn in parallel with the insulator and a dielectric spark gap device connected in parallel across the insulator.

17 Claims, 5 Drawing Sheets

CURRENT PAUSE DEVICE FOR AN ELECTRIC POWER CIRCUIT INTERRUPTER

PRIORITY CLAIM TO RELATED APPLICATION

This application claims priority to commonly-owned U.S. Provisional Patent Application Ser. No. 60/548,698 entitled "Current Pause Interrupter," filed on Feb. 27, 2004.

TECHNICAL FIELD

The present invention relates to the field of high voltage switchgear for electric power transmission and distribution systems, and more particularly to a current pause device for enhancing the performance of circuit interrupters used in these circuits.

BACKGROUND OF THE INVENTION

High voltage transmission and distribution lines crisscross the country and bring electricity to homes and businesses from sea to shining sea. Occasionally, these electric power lines need to be taken out of service for some reason, such as testing, maintenance, upgrade, repair, and so forth. When taking the electric power lines out of service, a first end is opened, then the second end. When the first end has been opened and the second end is still at line voltage, the electric power line forms a large, geographic capacitor between the line conductors, at line potential, and ground. The charging current for a typical electric power line in this state is on the order of five to several hundred amperes, which represents a significant amount of stored energy when system voltage is on the order of 25 kV to 242 kV.

In order to completely disconnect a charged transmission line, the circuit must be opened through a circuit interrupter without causing a current flash-over to ground. This is typically performed with an air-arcing switch for a disconnect switch at certain voltages, an $SF_6$ dielectric switch at intermediate voltages, and a circuit breaker at higher voltages. The arcing current has a tendency to restrike between current zero crossings as the voltage periodically alternates toward the maximum voltage while the circuit interrupter opens creating an increasing arc gap. As the circuit interrupter arc gap widens so does the magnitude of the current restrikes across the arc gap. The voltage build up across the arc gap correspondingly increases, which at a critical point causes the current to flash-over to ground if the circuit is not broken before the voltage across the arc gap reaches this critical point. High current restrikes degrade the circuit interrupter, and more importantly current flash-over events cause dangerous conditions at the substation and also injects voltage and current spikes back into the electric power system which can be potentially damaging to power system equipment and connected loads.

As a result the rating and operational capacity of the circuit interrupter is limited by its ability to break the circuit at a sufficiently low voltage build up across the arc gap to prevent a current flash-over. This corresponds directly to the number of current restrikes that occur before the circuit is broken because each successive restrike occurs across an increasing wide arc gap, corresponding in turn to an increasing large voltage across the arc gap. This is equivalent to saying that the longer the time to break the circuit, the larger the number of restrikes, and the greater the chance for flash-over. Thus, allowing the circuit interrupter to break the discharging circuit at a lower arc gap voltage than would occur without the current pause device, and thereby increases the current and voltage rating as well as the operational capability of the circuit interrupter.

Accordingly, there is an ongoing need for a cost effective circuit interrupters and associated devices that increase the current and voltage rating as well as the operational capability of circuit interrupters.

SUMMARY OF THE INVENTION

The present invention meets the needs described above through the use of a current pause device that is connected in series with and configured to enhance the operation of transmission and distribution line circuit interrupters. The circuit interrupter opens the electric power circuit, while the current pause device delays the voltage build across the circuit interrupter arc gap for a time period sufficient to allow the dielectric characteristic of the medium within the arc to recover. The current pause device also includes a voltage protection arrangement to limit the voltage across the current pause device and thereby prevent a voltage breakdown across the current pause device. This allows the circuit interrupter to break the circuit at a lower voltage across the circuit interrupter than would occur without the current pause device.

As a result, the current and voltage ratings as well as the operational performance of the circuit interrupter are improved. This allows, for example, a circuit interrupter originally designed for a particular system voltage to operate at a higher system. For new applications, the current pause device allows smaller and less expensive circuit interrupters to do the job that previously required larger and more expensive circuit interrupters. In addition, the current pause device can be easily installed as original equipment in new electric power applications or in a retrofit application for existing applications. It will be appreciated that this type of current pause device may be designed to be inexpensive, effective, easy to construct, easy to install, and designed to operate at a wide range of system voltages.

Generally described, the invention may be implemented as an electric power current pause device for enhancing the ability of a circuit interrupter to open an electric power transmission or distribution circuit. The circuit interrupter operates to open the electric power circuit, and when doing so the circuit interrupter creates an arc across an arc gap in a dielectric medium, such as air, $SF_6$ or another suitable dielectric medium. This causes a corresponding voltage build up across the arc gap as the circuit interrupter opens. The current pause device, which is connected in series with the current interrupter, operates to delay the voltage build across the circuit interrupter arc gap for a time period sufficient to allow the dielectric characteristic of the medium within the arc to recover. The current pause device also includes a voltage protection arrangement to limit the voltage across the current pause device and thereby prevent a voltage breakdown across the current pause device. As noted above, this configuration allows the circuit interrupter to break the circuit at a lower voltage across the arc gap than would occur without the current pause device.

In particular, the current pause device may include a conductive arcing horn and an insulator interposed in the arcing horn to create a conductive gap in the arcing horn, and the voltage protection arrangement including a unidirectional conductor, such as a diode, SCR or IGBT, connected to the arcing horn in parallel with the insulator, and a dielectric spark gap device connected in parallel across the insulator. The current pause device may be designed to operate in the general range of 25 kV to 242 kV, and may operate in series with an air-arcing disconnect switch, an $SF_6$ circuit interrupter, a circuit breaker or any other electric power circuit interrupter. The current pause device may also be designed used to enhance the operation of the circuit interrupter when discharging the capacitive energy stored on a charged transmission or distribution line. However, it may also be in connection with circuit interrupters in other circuit opening applications.

In a particular embodiment, the invention may be implemented as a disconnect switch including a current pause device for an electric power transmission line. The disconnect switch includes a disconnect jaws having an arcing horn configured to intermittently enter into electrical contact with a disconnect blade of a disconnect arm. The disconnect blade is moveable during an opening stroke from a closed position in electrical contact with the arcing horn to an open positing insulated from the arcing horn to disconnect the transmission line from a system voltage. In addition, the disconnect blade and the arcing horn form an air gap during the opening stroke of the disconnect switch. The disconnect switch also include a current pause device that has an insulator within the arcing horn, a unidirectional conductor, and a dielectric spark gap device connected in parallel across the insulator to prevent a potentially damaging arc restrike during the opening stroke of the disconnect switch.

The disconnect switch may be configured for a variety of commonly-used distribution voltages. In general, the disconnect is configured to permit no more than two arc restrikes during the opening stroke of the disconnect switch, and to limit the discharge current across the air gap to no more than twenty amperes. These parameters may be achieved for a disconnect switch that achieves an opening speed in the range of 50 to 100 inches/second (127 to 254 cm/sec) at the time of a final restrike, when the electric circuit is broken. For a typical disconnect switch, the arcing horn has a longitudinal dimension of length of approximately six inches (15.24 cm), the insulator has a length in the longitudinal dimension of approximately one-half inch (1.27 cm), and the dielectric spark gap has a dielectric gap of approximately 1/16 inch (15.875 cm). In addition, the unidirectional conductor is typically rated for approximately 300 Amperes in a first current flowing direction and approximately 4 kV in a first current flowing direction.

The specific techniques and structures for implementing particular embodiments of the current interrupter, and thereby accomplishing the advantages described above, will become apparent from the following detailed description of the embodiments and the appended drawings and claims.

DETAILED DESCRIPTION OF THE EMBODIMENTS

It will be appreciated that the present invention provides significant improvements in circuit interruption equipment for electric power transmission and distribution lines. Specifically, the circuit interrupter enhances the operation of a circuit interrupter by delaying the voltage build across the circuit interrupter arc gap for a time period sufficient to allow the dielectric characteristic of the medium within the arc to recover. This allows the circuit interrupter to break the circuit at a higher current than would occur without the current pause device. The current pause device may be operated in the range of 25 kV to 242 kV, and may operate in series with an air-arcing disconnect switch, an $SF_6$ circuit interrupter, a circuit breaker or any other electric power circuit interrupter. The current pause device may also be designed to enhance the operation of the circuit interrupter when opening the electrical connection between a capacitively charged transmission or distribution line and ground. However, it may also be in connection with circuit interrupters in other circuit opening applications.

Figure 1:
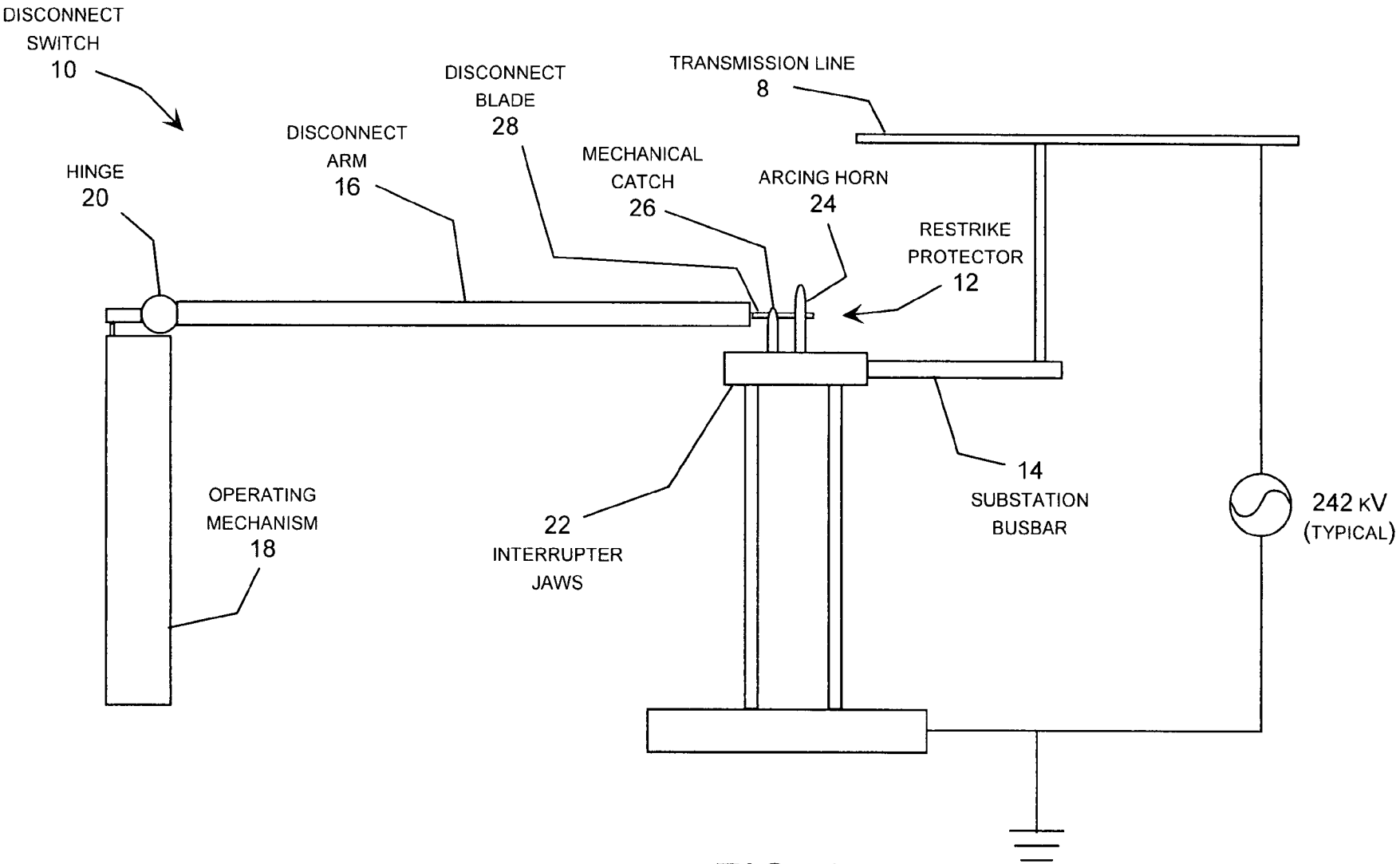
FIG. 1 is a functional block diagram of a current pause device connected in series with a circuit interrupter in an electric power system.

Referring now to the drawings in which like elements refer to like elements throughout the several figures, FIG. 1 is a functional block diagram of a representative electric power circuit including an electric power line 8, typically a transmission or distribution line, operating at its designed system voltage. The circuit also includes a circuit interrupter 10 connected in series with a current pause device 12 to open the transmission or distribution line 2. As noted above, the system voltage may be in the range of the range of 25 kV to 242 kV and the circuit interrupter 10 may be an air-arcing disconnect switch, an $SF_6$ circuit interrupter, a circuit breaker or any other electric power circuit interrupter as appropriate for the particular system voltage. A disconnect switch embodiment for distribution voltages is described below with reference to FIGS. 2-6.

Figure 2:
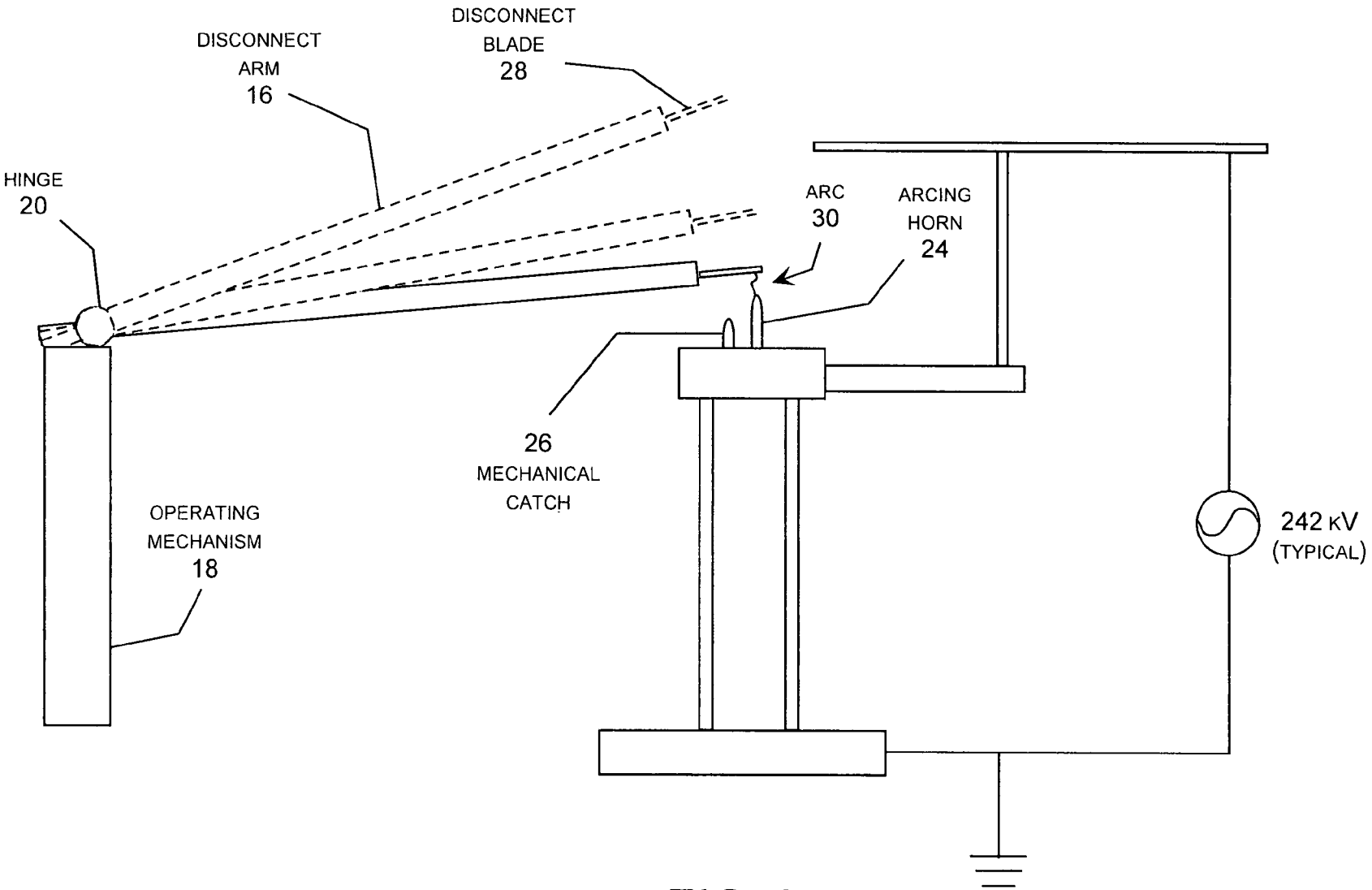
FIG. 2 is a side view conceptual illustration of a disconnect switch including of current pause device.

FIG. 2 is a side view conceptual illustration of a distribution line 8 operating at a typical distribution system voltage of 25 kV. The distribution line 8 has an associated current interrupter, in the example disconnect switch 10, connected in series with a current pause device 12. It will be understood that FIG. 2 is a conceptual illustration of one phase of the disconnect switch, which is not shown to scale, and for which the particular dimensions will vary based on the system voltage. Nevertheless, the conceptual illustration of FIG. 2 is sufficient to illustrate the inventive features as deployed in this particular embodiment.

The disconnect switch 10 is opened by the operating mechanism 18, which triggers to swing open disconnect arm 16 and thereby disconnect the disconnect blade 28 from the interrupter jaws 22, This, in turn, electrically disconnects the distribution line 8 from the system voltage. As noted previously, the typical application of the disconnect switch 10 is to disconnect the distribution line 8 from the system voltage when the distribution line has already been disconnected at another end but remains connected to the system voltage, but it may be used for other disconnect purposes. For a capacitively energized distribution, the charging current is typically in the range of 5 to 300 Amperes, which corresponds to a significant charging energy at a distribution system voltages. This charging energy is discharge to ground through the disconnect switch 10 as the electric circuit is opened.

Figure 3:
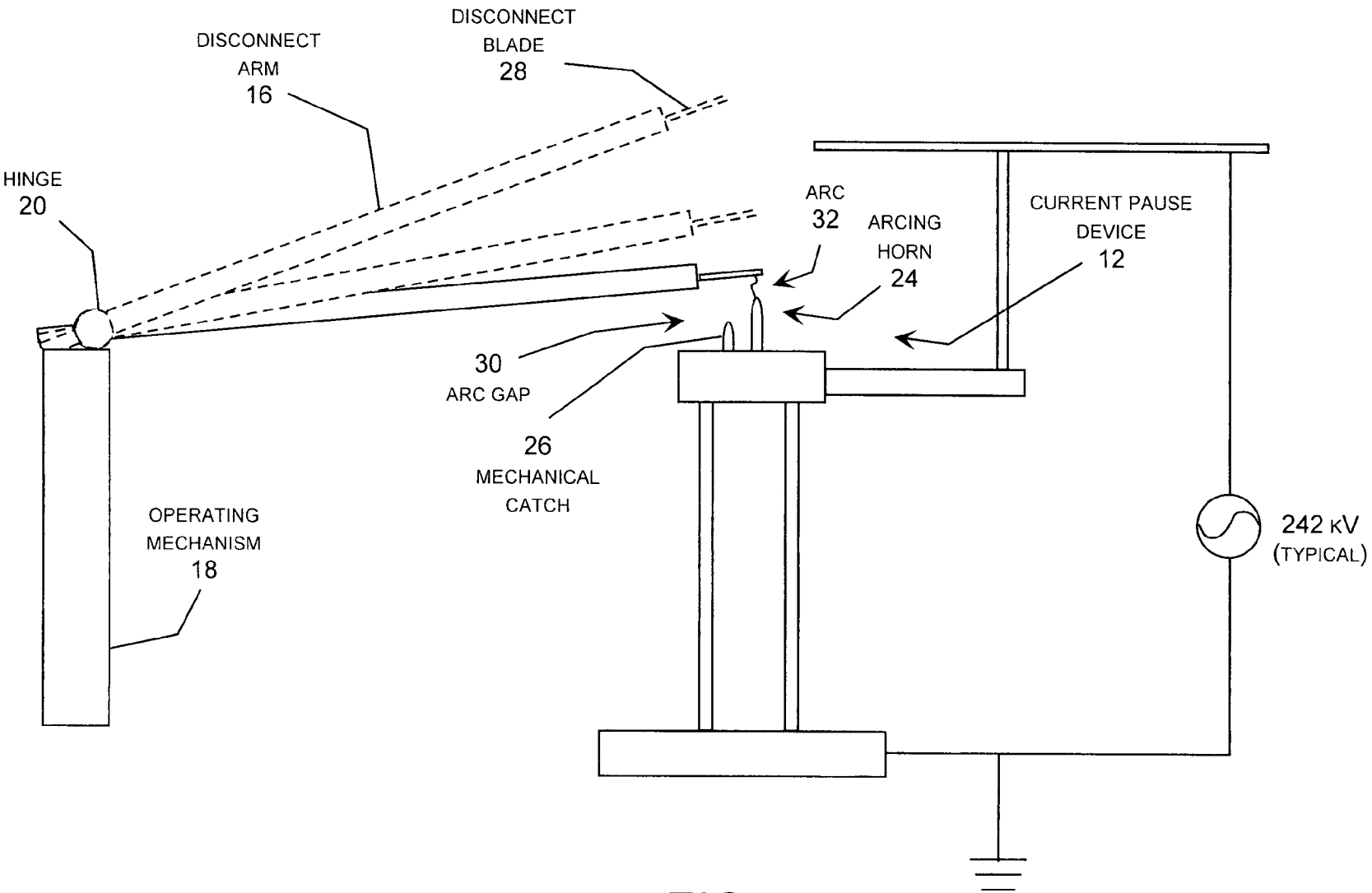
FIG. 3 is a side view conceptual illustration an opening stroke of the disconnect switch of FIG. 1.

As shown in FIG. 3, an arc 32 forms in across and arc gap 30 between the disconnect blade 28 and an disconnect jaws 24 within the disconnect switch 10. The disconnect switch includes a current pause device 12, which is shown in more detail in FIGS. 4-5, to limit the number of current restrikes and the associated voltage build up across the arc gap 30, and thereby reduce the instances in which a current flash-over occurs, which increases the current and voltage rating of the disconnect switch 10.

The disconnect switch also includes a mechanical catch 26 to hold the disconnect arm 16 in place until the operating mechanism 18, which is typically spring operated, has generated a significant amount of mechanical potential energy. This creates a sling-shot effect that accelerates the opening stroke of the disconnect blade 28 to approximately 50 to 100 inches/second (127 to 254 cm/sec) at the time of circuit opening. The disconnect switch 10 is typically configured to break the electric circuit with no more then two restrikes and thereby limit the physical degradation to the disconnect switch 10 caused by restrikes, which lengthens the life of the disconnect switch and limits the voltage build up across the arc gap 30 to prevent potentially damaging current flash-over.

Figure 5:
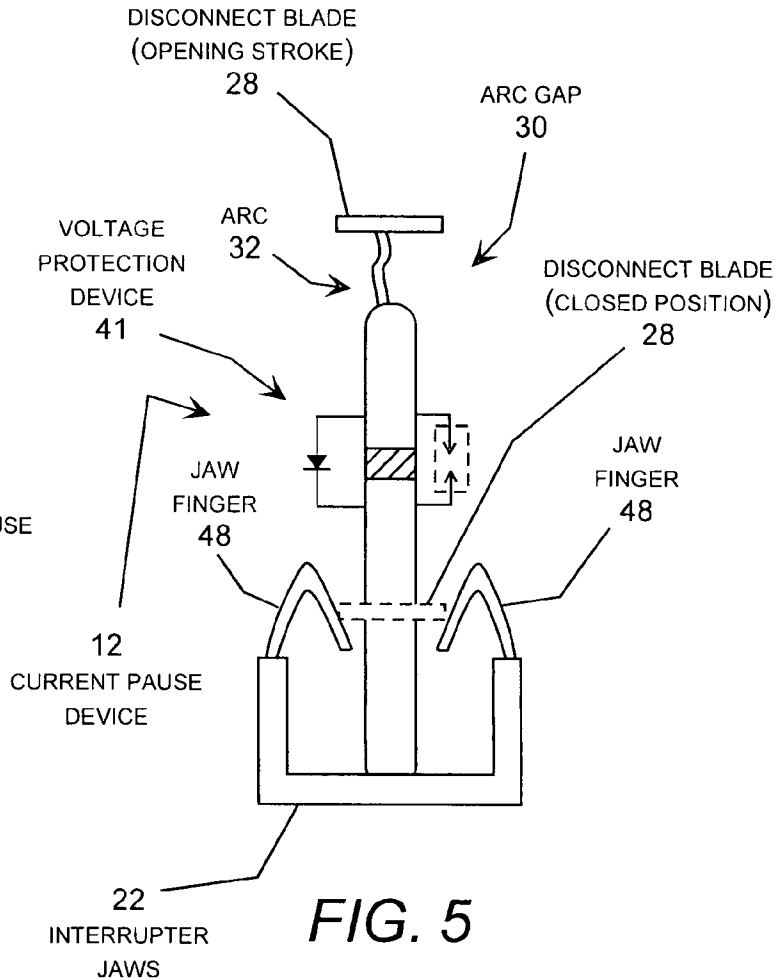
FIG. 5 is an end view conceptual illustration a current pause.
Figure 4:
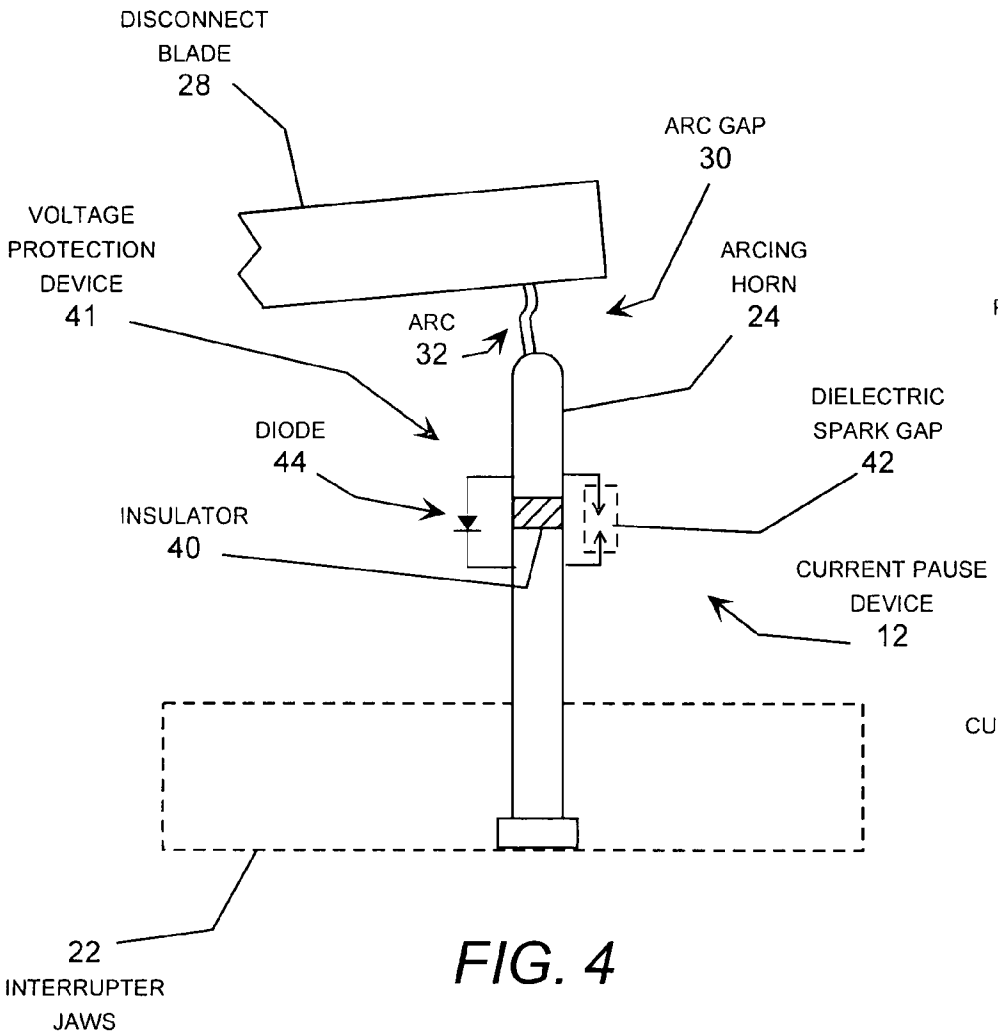
FIG. 4 is a side view conceptual illustration a current pause.

FIG. 4 is a side view conceptual illustration showing the current pause device 12 in greater detail. FIG. 5 shows an end view of the same device. The current pause device includes an insulator 40 interposed within the arcing horn 24. The current pause device 12 also includes a voltage protection device 41 including a unidirectional conductor, in this embodiment a diode 44 in parallel with the insulator and a dielectric spark gap 42 in parallel with the diode and insulator. The diode 44 permits current to flow inward through the diode, and around the insulator, during the positive portion of the alternating current. The current then passes through a current zero and begins to flow in the opposite direction. As it does so, the diode blocks the current and causes the voltage to build across the diode 44 and the dielectric spark gap 42 toward the breakdown voltage of the diode. But before the diode reaches its break-down voltage, the dielectric spark gap 42 begins conducting the current through its internal dielectric gas. This delay, as the voltage across the diode builds until the current is released though the dielectric spark gap, creates a current pause through the arc gap 30. This time delay allows the ionization in the air gap 30 to dissipate sufficiently to restore the dielectric characteristic of the dielectric medium in the air gap, in this embodiment air, and thereby breaking the circuit at a lower voltage across the air gap 30 enhance the operation of the disconnect switch 30. Although the particular design parameters must be adjusted, it will be appreciated that the same operating principle operates to accomplish the same technical result and associated benefits in any type of circuit interrupter and dielectric medium, and at any system voltage.

Figure 6:
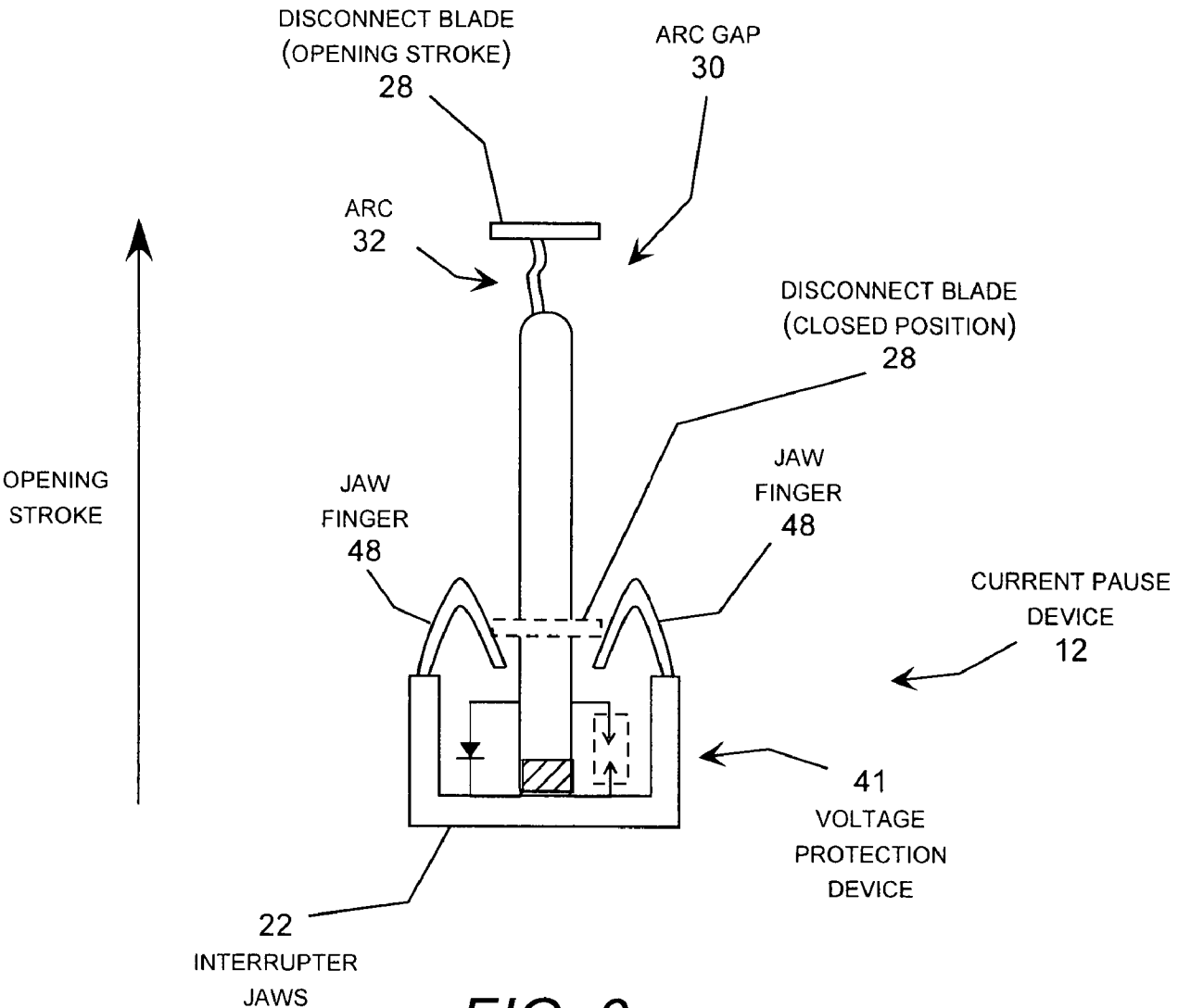
FIG. 6 is an end view conceptual illustration an alternative current pause.

FIG. 6 illustrates the fact that the parallel configuration of the insulator 40, diode 44 and dielectric spark gap 42 can be placed anywhere along the arcing horn 24. FIG. 6 shows a preferred arrangement in which a butt diode located at the base of the arcing horn 24 serves as the insulator 40 and diode 44. A typical set of design parameters for current pause device 12 in this application are: The disconnect switch 10 achieves an opening speed in-the range of 50 to 100 inches/second (127 to 254 cm/sec) at the time of circuit opening. The arcing horn 24 has a longitudinal dimension of length of approximately six inches (15.24 cm). The insulator has a length in the longitudinal dimension of approximately one-half inch (1.27 cm), and the dielectric spark gap has a dielectric gap of approximately 1/16 inch (15.875 cm). In addition, the diode is rated for approximately 300 Amperes in a first current flowing direction and a break down voltage of approximately 4 kV for current flowing in the opposite direction. Those skilled in the art will appreciate that these parameters can all be varied somewhat, and that it is within the ability of a person skilled in the art of high voltage switchgear design to specify a different set of parameters for different operating voltages It should be understood that the foregoing relates only to the exemplary embodiments of the present invention, and that numerous changes may be made therein without departing from the spirit and scope of the invention as defined by the following claims.

The invention claimed is:

1. An electric power current pause device for enhancing the ability of a circuit interrupter to open an electric power transmission or distribution circuit, the circuit interrupter creating an arc across an arc gap in a dielectric medium in response to voltage build up across the arc gap as the circuit interrupter opens, wherein:

the current pause device is configured to be connected in series with the circuit interrupter, and is further configured to delay the voltage build up across the circuit interrupter arc gap for a time period allowing the dielectric characteristic of the medium within the arc gap to recover sufficiently to break the circuit at a lower arc gap voltage than would occur without the current pause device; and the current pause device further comprising a voltage protection arrangement to limit the voltage across the current pause device and thereby prevent a voltage breakdown across the current pause device.

2. The current pause device of claim 1, further comprising:

a conductive arcing horn; and wherein the voltage protection arrangement comprises an insulator interposed in the arcing horn to create a conductive gap in the arcing horn, and a unidirectional conductor connected to the arcing horn in parallel with the insulator, and a dielectric spark gap device connected in parallel across the insulator.

3. The current pause device of claim 1 configured to enhance the circuit breaking performance of an air-arcing disconnect switch.

4. The current pause device of claim 1 configured to enhance the circuit breaking performance of an $SF_6$ circuit interrupter.

5. The current pause device of claim 1 configured to enhance the circuit breaking performance of a circuit breaker.

6. The current pause device of claim 1 configured to operate at a system voltage in the range of 25 kV to 242 kV.

7. A disconnect switch, comprising:

a disconnect jaw having an arcing horn configured to intermittently enter into electrical contact with a disconnect blade of a disconnect arm;

the disconnect blade configured for intermittent electrical contact with the arcing horn, the disconnect blade being moveable during an opening stroke from a closed position in electrical contact with the arcing horn to an open positing insulated from the arcing horn to disconnect the transmission line from a system voltage;

the disconnect blade and the arcing horn forming an air gap during the opening stroke of the disconnect switch; and the disconnect switch further comprising a current pause device including an insulator within the arcing horn, a unidirectional conductor, and a dielectric spark gap device connected in parallel across the insulator to prevent a potentially damaging arc restrike during the opening stroke of the disconnect switch.

8. The disconnect switch of claim 7, wherein the system voltage is in the range of approximately 25 kV to approximately 242 kV.

9. The current pause device of claim 7, configured to limit a discharge current across the air gap to no more than twenty amperes.

10. The disconnect switch of claim 7, wherein the disconnect switch achieves an opening speed in the range of 50 to 100 inches/second (127 to 254 cm/sec) at the time of a final restrike, when the electric circuit is broken.

11. The disconnect switch of claim 7, wherein the arcing horn has a longitudinal dimension of length of approximately six inches (15.24 cm), the insulator has a length in the longitudinal dimension of approximately one-half inch (1.27 cm), and the dielectric spark gap has a dielectric gap of approximately 1/16 inch (15.875 cm).

12. The disconnect switch of claim 7, wherein:

the unidirectional conductor is rated for approximately 300 Amperes in a first current flowing direction and approximately 4 kV in a first current flowing direction.

13. The disconnect switch of claim 7, wherein the disconnect switch is configured to achieve an opening speed in the range of 50 to 100 inches/second (127 to 254 cm/sec) at the time of a final restrike, when the electric circuit is broken.

14. A method for opening an electric power circuit, comprising:

providing a circuit interrupter in the electric power circuit, the circuit interrupter configured to open the electric power circuit by creating an arc across an arc gap in a dielectric medium in response to voltage build up across the arc gap as the circuit interrupter opens;

providing a current pause device connected in series with the current interrupter and configured to delay the voltage build across the circuit interrupter arc gap for a time period allowing the dielectric characteristic of the medium within the arc gap to recover sufficiently to break the circuit at a lower arc gap voltage than would occur without the current pause device, the current pause device further comprising a voltage protection arrangement to limit the voltage across the current pause device and thereby prevent a voltage breakdown across the current pause device; and opening the circuit interrupter, energizing the current pause device, and opening the electric power circuit.

15. The method of claim 14, further comprising the step of providing the current pause device with and arcing horn, an insulator interposed in the arcing horn to create a conductive gap in the arcing horn, a unidirectional conductor connected to the arcing horn in parallel with the insulator, and a dielectric spark gap device connected in parallel across the insulator.

16. The method of claim 14, further comprising the step of configuring the current pause device to operate at a system voltage in the range of 25 kV to 242 kV.

17. The method of claim 14, further comprising the step of configuring the current pause device to enhance the operation of a disconnect switch, an $SF_6$ circuit interrupter, or a circuit breaker.

* * * * *